United States Patent [19]

Dandrel et al.

[11] 4,101,811

[45] Jul. 18, 1978

[54] DELAYED EXTINCTION CONTROL

[76] Inventors: Francois Dandrel, 12 Chemin Renaudin, 92260 Fontenay-aux-Roses; Jean-Pierre Bouvier, Residence Bellevue, 91310 Nozay, both of France

[21] Appl. No.: 649,650

[22] Filed: Jan. 16, 1976

[30] Foreign Application Priority Data

Jan. 16, 1975 [FR] France ..... 75 01225

[51] Int. Cl.[2] ..... H05B 37/02; H05B 39/06

[52] U.S. Cl. ..... 315/200 R; 307/141; 307/146; 315/205; 315/207; 315/360; 315/362; 361/196

[58] Field of Search ..... 315/200 R, 205, 207, 315/360, 362, 82, 84, 119, 194, 199, DIG. 4, 100, 101, 104; 307/141, 141.4, 146; 317/141; 361/195, 196, 202

[56] References Cited

U.S. PATENT DOCUMENTS

| | | | |
|---|---|---|---|
| 2,334,194 | 11/1943 | Hinshelwood | 315/362 X |
| 3,017,623 | 1/1962 | Bishofberger | 315/360 X |
| 3,061,758 | 10/1962 | Cobb | 315/360 X |
| 3,247,358 | 4/1966 | Schmidt | 307/146 X |
| 3,339,105 | 8/1967 | Busse | 315/101 |
| 3,898,516 | 8/1975 | Nakasone | 315/199 X |

*Primary Examiner*—Eugene R. LaRoche

[57] ABSTRACT

Alternating current energized appliances, particularly lamps, are extinguished in delayed fashion with the power delivered to the appliance being sharply reduced during at least the last portion of the extinction cycle. Delayed interruption of power is accomplished by means of a first circuit, including a series connected diode and heater, connected in parallel with the appliance and a second circuit, including a series connected diode and temperature responsive switch, connected in parallel with a main power switch. The heater and temperature responsive switch are mounted in proximity to one another and the diodes are arranged in opposition.

10 Claims, 8 Drawing Figures

DELAYED EXTINCTION CONTROL

BACKGROUND OF THE INVENTION (1) Field of the Invention

The present invention relates to the control of alternating current powered appliances and particularly to the exercise of control over electric lamps. More specifically, the present invention is directed to time delay circuits for discontinuing the delivery of alternating current to electrically energized devices through stepwise reductions in power. Accordingly, the general objects of the present invention are to provide novel and improved methods and apparatus of such character.

(2) Description of the Prior Art

While not limited thereto in its utility, the present invention is particularly well suited for use in the control of alternating current energized electric lamps. There are innumerable situations wherein it is necessary or desirable to take steps to extinguish a lamp while insuring that the area in which the lamp is situated will remain illuminated for a sufficient period to permit safe egress therefrom. In the past this has been accomplished through the use of conventional time delay switches either built into the lamp or otherwise connected in the circuit through which power is supplied to the lamp.

The use of conventional time delay switches has failed to recognize and/or solve a physiological problem associated with the automatic extinguishing of lamps subsequent to the departure from the vicinity of the lamp of the individual commanding the extinguishing action. Thus, existing lighting devices with delayed extinction abruptly plunge the room or other area into darkness at the end of the normal time delay period and it is extremely difficult to gauge the time remaining before the end of the temporary delay period. This inability to accurately gauge the time remaining before illumination ceases results either in undue haste, with the inherent potential for accident, or may leave the individual "stranded" in the dark.

The above-discussed problem, incident to the inability to accurately measure the time remaining before interruption of power to a lamp equipped with a time delay switch, has previously been solved by resort to a multiplicity of switches. Thus, in commercial and residential wiring, it is common practice to provide switches adjacent each exit doorway; there typically being as many switches as there are lamps in the room which one desires to individually control. This multiplicity of switches results in substantial added expense.

SUMMARY OF THE INVENTION

The present invention overcomes the above briefly discussed and other disadvantages of the prior art by providing a novel and improved technique for the control of alternating current powered devices such as lamps. Apparatus for practicing the technique of the present invention is characterized by moderate expense and small size. Thus, in accordance with the invention, the current supply to a controlled device will be reduced in response to the opening of the primary current supply circuit to such device. Thus, in the case of a lamp, the primary circuit may be opened through the use of a time delay switch and the current supply to the lamp will thereupon be suddenly reduced so as to dim the lamp thereby providing an indication that a portion, for example one-half, of the time between operation of the switch and total cessation of the delivery of power to the lamp has expired.

The preceding objectives are accomplished, in accordance with a preferred embodiment of the invention, by connecting a heating element and a first rectifier in parallel with the load and at the load side of a primary control switch. A temperature sensitive secondary switch and a further rectifier, the further rectifier being connected in opposite polarity to the first rectifier, are connected in parallel with the primary switch with the temperature sensitive switch being located in proximity to the heating element.

BRIEF DESCRIPTION OF THE DRAWING:

The present invention may be better understood and its numerous objects and advantages will become apparent to those skilled in the art by reference to the accompanying drawing wherein like reference numerals refer to like elements in the several figures and in which.

Figure 1:
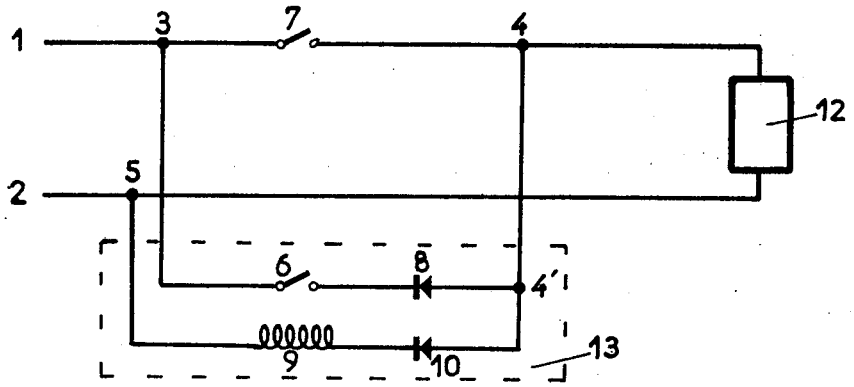
FIG. 1 is an electrical schematic diagram of a control circuit in accordance with the present invention associated with a load.

DESCRIPTION OF THE PREFERRED EMBODIMENTS:

Referring now to FIG. 1, the terminals of a standard single phase alternating current source; a 120 or 240 volt source for example; are indicated at 1 and 2. With a primary control switch 7 closed, current is delivered to a load 12, which may be an electric lamp, from the source connected to terminals 1 and 2. The primary control switch 7 may be manually or automatically operated and may include a conventional time delay mechanism. A circuit including a series connected heater element 9 and diode 10 is connected in parallel with load 12; i.e., the heater and diode are connected between junction points 4 and 5. While shown as an inductive element, the heater 9 will conventionally be a resistance heater. A circuit including a temperature responsive secondary switch 6 and series connected diode 8 is connectd in parallel with the primary control switch 7; the circuit including switch 6 and diode 8 being connected between junction points 3 and 4 and the cathodes of diodes 8 and 10 being connected to common point 4'. As will be obvious from the discussion below, diodes 8 and 10 are connected in opposition to one another. The circuit including heater 9 and diode 10 and the circuit including switch 6 and diode 8 are positioned within a common housing, indicated at 13, and the spatial placement of switch 6 with respect to heater 9 is such that there will be good heat transmission between these two components.

Considering now the operation of the control of FIG. 1, if switches 6 and 7 are initially open as shown there will be no current delivered to the load 12 and, if the load is an electric lamp, the lamp will not be energized. Upon the closing of switch 7, either manually or through the action of an electromechanical timer device, power will be delivered from the alternating current supply connected to terminals 1 and 2 to load 12; current being delivered to the load during each half cycle of the alternating current source. Simultaneously, current will flow through the parallel circuit comprising diode 10 and heating element 9 via junction points 4, 4' and 5. Because of the presence of diode 10, there will be current flow through heating element 9 only during alternate half cycles of the supply. After a time period determined by the characteristics of heater 9 and temperature responsive switch 6, and the physical proximity of these two components, switch 6 will also be closed.

Upon the opening of contacts of switch 7, and it will be understood that switch 7 may be a standard time delay switch which will open a predetermined time after the operation of the switch by either an individual or electro-mechanical timer, any current delivered to load 12 must be via the circuit comprising the contacts of switch 6 and diode 8 which is in parallel with the now open switch 7. Accordingly, current will be delivered to load 12 only during alternate half cycles of the supply. The power delivered to load 12 is thus diminished and, if the load is an electric lamp, the intensity of the lamp will be reduced by approximately one-half. With switch 7 open and switch 6 closed, because of the relative polarity of diodes 8 and 10, current flow through heating element 9 will be terminated and the heater will begin to cool. When heating element 9 has sufficiently cooled, the switch 6 will return to its normally open condition thus terminating the supply of power to load 12.

As will be obvious from the description above, a delayed extinction circuit with a sudden power reduction during the period of delay has been provided if switch 7 is a conventional on-off switch. If switch 7 is a conventional time delay switch, the circuit of FIG. 1 constitutes a control having two successive delays with the first delay being due to the time delay switch 7, with full power being delivered to the load, and the second delay being due to the operation of the circuit positioned in housing 13 with approximately one-half power being delivered to the load during the second delay period. Thus, when used in association with a lamp, the present invention permits the user to operate, to the off position, a lamp situated in the middle of a room and allows ample time to gain access either to the exit of the room or to the control of a second lamp which will provide sufficient illumination. As an example utilization, it may be presumed that the load 12 constitutes a light in a staircase or corridor. Presuming switch 7 is a time delay device, the user will know approximately the time at his disposal after initiating the lamp extinction mode of operation and, during his traverse of the space, the user will receive a "message" by the abrupt reduction in intensity of the lamp which serves as a warning that a portion, for example one-half, of the time available to reach a lighted area or source of light has expired.

Figure 2:
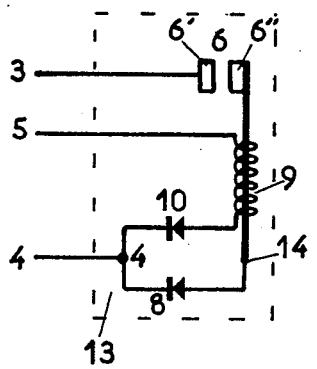
FIG. 2 is an electrical schematic diagram representing a first embodiment of the time delay portion of the circuit of FIG. 1.

In accordance with one embodiment of the invention, as depicted in FIG. 2, the switch 6 comprises a bimetallic strip which has been represented schematically at 14; bimetallic strip 14 carrying movable contact 6'' of the temperature responsive switch 6. In the FIG. 2 embodiment the heating element 9 has been shown as a resistance wire wound about strip 14. While this is the preferred arrangement, the heating element 9 may actually be made a part of bimetallic strip 14.

Figure 3:
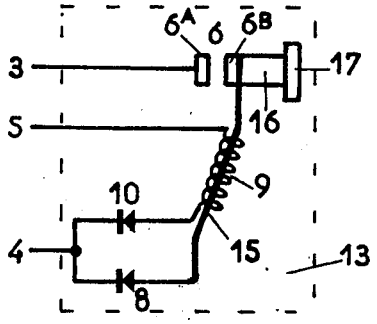
FIG. 3 is an electrical schematic diagram of a second embodiment of the time delay portion of the circuit of FIG. 1.

In the FIG. 3 embodiment the bimetallic strip 14 has been replaced by a metal lamina 15 which is selected for its heat transfer characteristics; i.e., member 15 must be good heat conductor and present a certain degree of elasticity. Member 15 carries the contact 6B of the temperature responsive switch 6 and a body 16 of a material. The material comprising body 16 possesses a Curie point selected in accordance with the desired operating temperature for closing the contacts 6A and 6B of switch 6. The body 16 may, for example, be comprised of the material commercially available under the tradename "Ferox". Element 16 will be normally maintained in the position shown by means of a magnet 17. In the FIG. 3 embodiment the heating of body 16 is accomplished by conduction and, when the Curie temperature is reached, the permeability of body 16 will decrease rather abruptly and magnet 17 will no longer hold the contacts of switch 6 open; the switch contacts 6A and 6B thus being closed as a result of the elasticity of member 15.

Figure 4:
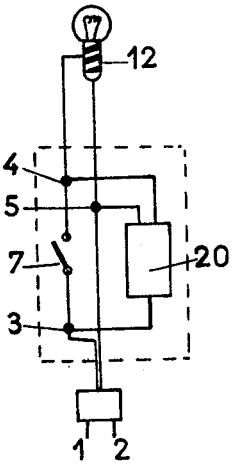
FIG. 4 is a further schematic diagram which depicts the present invention associated with an electric lamp.

Referring now to FIG. 4, the elements depicted as being positioned within housing 13 in FIGS. 1-3 are located within a housing 20 which, in turn, is located within a further housing or control box which includes the switch 7. The FIG. 4 arrangement is particularly well suited for retrofitting previously installed lamps.

Figure 5:
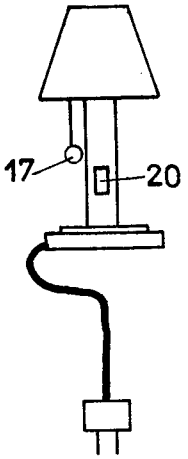
FIG. 5 represents a miniaturized version of the present invention installed in the base of an electric lamp.
Figure 6:
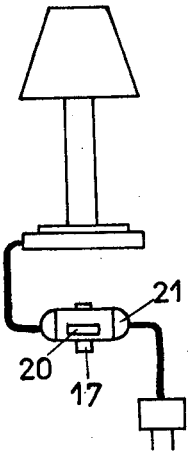
FIG. 6 represents a miniaturized version of the present invention installed in the line cord to an electric lamp.

FIGS. 5 and 6 depict two different possibilities for the installation of housing 20 on or in association with a portable lamp. In the FIG. 5 embodiment the housing is mounted in the stem or base of the lamp and switch 7 is operated, in the conventional manner, by means of a pull chain 17. In FIG. 6 the housing 20 is mounted within a further housing 21 which is interconnected in the line cord of the lamp; the actuator 17 for switch 7 extending from the housing 21.

Figure 7:
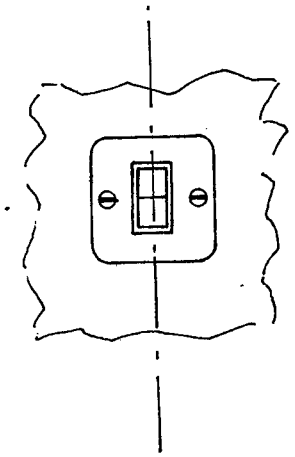
FIG. 7 is a front elevation view of a wall switch incorporating the present invention.
Figure 8:
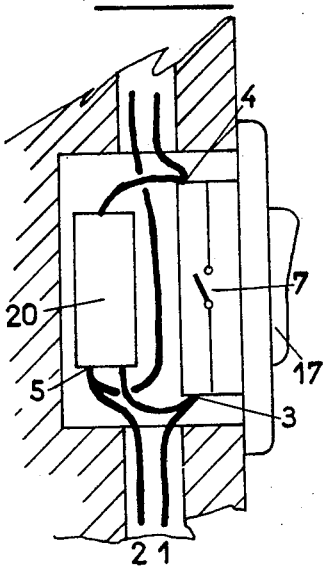
FIG. 8 is a cross-sectional side elevation view of the switch of FIG. 7.

FIGS. 7 and 8 depict the wall mounting of the control of the present invention. FIG. 7 is a front view while FIG. 8 is a cross-sectional partially schematic side elevation view of the control of FIG. 7; FIG. 8 showing the control in enlarged form when compared to FIG. 7. The actuator 17 for switch 7, as may be seen from FIG. 8, is a "see-saw" type control button which is mechanically coupled to the contacts of the switch. In the embodiment of FIGS. 7 and 8 the housing for switch 7 has been enlarged so as to accommodate the delay circuit housing 20.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method of controlling the deenergization of an alternating current powered electrical appliance, a primary control switch selectively establishing and interrupting a first current path between an alternating current supply and the appliance, a temperature sensitive secondary switch being positioned adjacent the appliance for selectively establishing and interrupting a second current path between the alternating current supply and the appliance independently of the primary control switch, the method comprising the steps of:

opening the primary control switch; delivering half-wave rectified current from the alternating current source to the appliance via the secondary control switch whereby the power delivered to the appliance is reduced to a predetermined level in a single step upon the opening of the primary control switch; and automatically terminating the delivery of half-wave rectified current to the appliance after a time delay by causing opening of the secondary switch.

2. The method of claim 1 wherein the step of delivering half-wave rectified current to the appliance comprises:

delivering half-wave rectified current from the alternating current source to an electrical heater upon closing of the primary control switch;

closing the secondary switch in response to heat produced by the heater; and delivering half-wave rectified current to the appliance via the secondary switch upon opening of the primary switch.

3. The method of claim 2 wherein the step of terminating delivery of half-wave rectified current to the appliance comprises:

discontinuing the delivery of rectified current to the heater upon the opening of the primary switch whereby the secondary switch will open when the temperature of the heating element falls to a predetermined level.

4. Apparatus for delaying the extinguishing of an alternating current energized source of illumination, the source of illumination including a primary control switch connected between a light emitter and current source, said delay apparatus comprising:

first circuit means connected in parallel with the light emitter, said first circuit means including electrically energized heating means and rectifier means connected in series between a first terminal of the current source and the load side of the primary control switch; and second circuit means, said second circuit means connected in parallel with the primary control switch and including a normally open temperature responsive secondary switch and second rectifier means, said second rectifier means being connected in opposite polarity with respect to said first rectifier means said second switch being responsive to thermal energy produced by said first circuit means heating means.

5. The apparatus of claim 4 wherein said temperature responsive secondary switch means and said heating means are positioned in proximity to one another in a common housing.

6. The apparatus of claim 5 wherein said secondary switch includes a bimetallic element, a first contact of said secondary switch being mounted on said bimetallic element for movement therewith.

7. The apparatus of claim 5 wherein said secondary switch includes:

a flexible member;

a first switch contact carried by said flexible member;

a magnetic member, said magnetic member being comprised of a material having a preselected Curie temperature and being mounted on said flexible member; and magnet means fixedly positioned in said housing so as to normally attract said magnetic member whereby said secondary switch is maintained in the open position against the resilient bias of said flexible member.

8. The apparatus of claim 5 wherein said housing is mounted in the base of a lamp.

9. The apparatus of claim 5 wherein said housing is interposed in the line cord by which current is supplied to a lamp.

10. The apparatus of claim 5 wherein said housing is mounted within a receptacle which is intended for installation in a wall, said receptacle also receiving the primary control switch.

* * * * *